United States Patent [19]

Ulrich

[11] Patent Number: 4,815,754

[45] Date of Patent: Mar. 28, 1989

[54] SAFETY BINDING FOR SKI

[75] Inventor: Gertsch Ulrich, Interlaken, Switzerland

[73] Assignee: Salomon S.A., Annecy, France

[21] Appl. No.: 483,514

[22] Filed: Apr. 11, 1983

Related U.S. Application Data

[63] Continuation of Ser. No. 351,638, Feb. 23, 1982, abandoned, which is a continuation of Ser. No. 122,264, Feb. 19, 1980, abandoned.

[30] Foreign Application Priority Data

Feb. 21, 1979 [AT] Austria ..... 1349/79
Aug. 10, 1979 [CH] Switzerland ..... 7340/79

[51] Int. Cl.[4] ..... A63C 9/08
[52] U.S. Cl. ..... 280/630; 280/636
[58] Field of Search ..... 280/620, 626, 629, 630, 280/633, 636, 611

[56] References Cited

U.S. PATENT DOCUMENTS 3,667,770 6/1972 Lawrence ..... 280/629
3,920,256 11/1975 Sittmann ..... 280/11.35 T
4,178,014 12/1979 Salomon ..... 280/629
4,219,217 8/1980 Gertsch ..... 280/629
4,260,175 4/1981 Salomon ..... 280/629
4,457,533 7/1984 Salomon ..... 280/628

FOREIGN PATENT DOCUMENTS 1578843 3/1971 Fed. Rep. of Germany ..... 280/636
2827717 1/1979 Fed. Rep. of Germany .
2838458 3/1979 Fed. Rep. of Germany .
7807805 10/1979 France .
7808342 10/1979 France .

*Primary Examiner*—Robert J. Spar
*Assistant Examiner*—Donald W. Underwood
*Attorney, Agent, or Firm*—Sandler & Greenblum

[57] ABSTRACT

A safety binding for a ski includes a jaw for holding the sole of a ski boot, the jaw being movable at least transversely with respect to the axis of the ski. The jaw is held in its normal position by an elastic member which returns it into its normal position after transverse movement. The jaw is associated with a pedal positioned under the end of the sole of the ski boot. This pedal includes a support member movable with respect to the ski as well as to the jaw.

29 Claims, 7 Drawing Sheets

SAFETY BINDING FOR SKI

This is a continuation of application Ser. No. 351,638, filed Feb. 23, 1982, now abandoned, which is a continuation of application Ser. No. 122,264, filed Feb. 19, 1980, now abandoned.

BACKGROUND OF THE INVENTION

The present invention relates to a safety binding for a ski.

In a known front safety stop, the pedal on which the sole of the boot is fixed is articulated with a guiding member associated therewith which may rotate about a joint secured to the ski and is combined with an elastic member (published German Patent Application No. 2827 717). In this apparatus, in the case of lateral pivoting of the associated member, there is virtually no relative displacement between the pedal and the boot sole, on the one hand, and between the jaw holding the sole and the front end of this latter, on the other hand. However, to achieve this advantage involves high construction and manufacturing costs, and the device is still sensitive to icing and clogging.

SUMMARY OF THE INVENTION

It is an object of the present invention to create a safety binding for a ski whose construction is as simple as possible, therefore with advantageous manufacturing costs, and whose operation cannot be substantially compromised by the presence of ice or dirt.

The safety binding for use with a ski according to the invention comprises a jaw for holding the sole of a ski boot, this jaw being movable at least transversely with respect to the axis of the ski and held in its normal position by a force of an elastic member which returns it into the normal position after a transverse movement, the jaw being associated with a pedal passing under the end of the sole of the ski boot. The pedal comprises a support member movable with respect to the ski as well as to the sole holding jaw.

In the binding according to the invention, the lateral pivoting of the sole holding-jaw produces virtually no relative displacement between the support member and the sole of the boot, as said support member may move with respect to said holding jaw, particularly by rotating. Consequently, the coefficient of friction between the sole of the ski boot and its support, which, as is known, is subjected to considerable variations, has no influence on the device for releasing the front stop.

BRIEF DESCRIPTION OF THE DRAWINGS

The invention will be more readily understood with reference to the accompanying drawings, in which.

DESCRIPTION OF THE PREFERRED EMBODIMENTS

Figure 1:
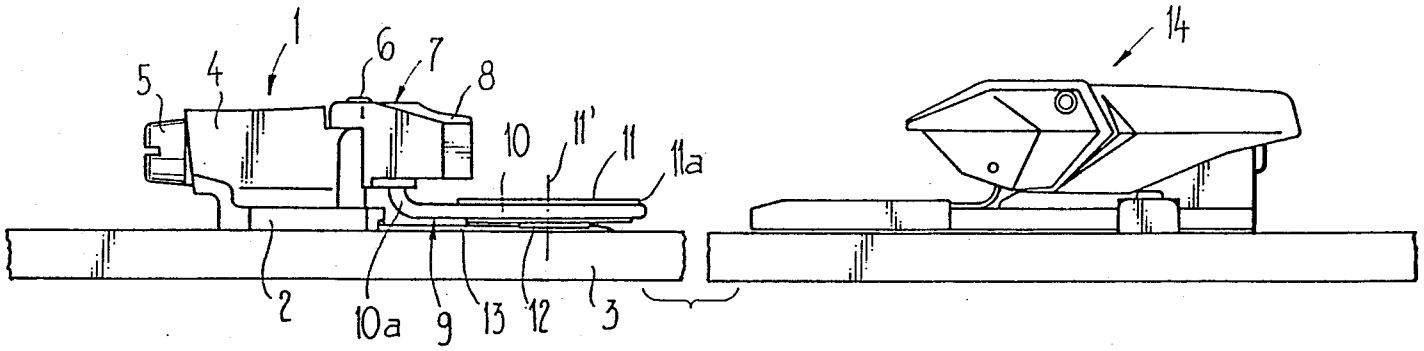
FIGS. 1 and 2 show, in side elevation and in plan view respectively, a ski binding comprising a front stop according to the invention, in its normal position.
Figure 2:
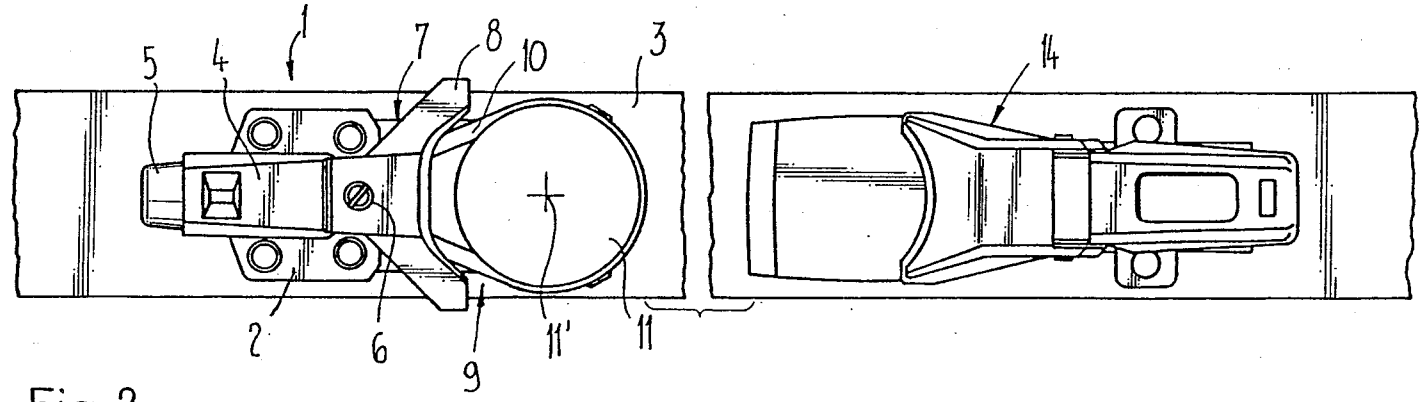

Referring to the drawings, FIGS. 1 and 2 show the front stop 1 which has a base plate 2 screwed on a ski 3. This base plate carries a casing 4 containing a release/-spring (not shown). The latter abuts, by one of its ends, on a front wall of the casing 4 and, by the other end, on an adjusting nut 5. The latter is screwed on an end of a tie rod (not shown) which passes through the casing 4 and whose other end carries a pin 6. This pin 6 is connected to a jaw 7 for holding the sole of a ski boot; this jaw comprising a holding member 8 adapted to hold the front end of the boot sole. The jaw 7 abuts, according to an arrangement which has not been shown, on pivoting stops of the base plate disposed at a certain distance from one another in the transverse sense. When the jaw 7 is in its normal position, as indicated in FIGS. 1 and 2, it is in abutment against its two pivoting stops. It may then pivot about one or the other of said stops. The structure and functioning of the front stop 1 are known per se and are explained more precisely in U.S. Pat. No. 3,920,256, for example.

A pedal 9, secured to the jaw 7 passes under the boot sole, the pedal comprising, in the embodiment illustrated, a thin metal stirrup-shaped member 10 substantially in the form of a U. The two ends 10*a* of this stirrup are bent upwardly and held in the jaw 7. When the latter pivots, it therefore moves stirrup 10 with it.

A support member 11 is housed in stirrup 10, which support member is in the form of a disc which may rotate about its axis 11' perpendicular to the plane of the ski. It is on this member 11 that the sole of the ski boot introduced into the binding rests. On its periphery, the support member 11 is provided with a groove 11*a* in which the stirrup 10 passes. The support member 11 is therefore prisoner of the stirrup whilst being able to rotate therein. The member 11 rests on a slide strip 12 held by a fixing plate fast with the ski 3. The slide strip 12 is preferably made of a plastic material, for example the one known under the name of "TEFLON", so as to minimize, and above all, even out under all circumstances the coefficient of friction between the support member 11 and the fixed member of the ski on which it rests.

To complete the drawings, a heel member 14 with automatic release, of conventional construction is shown. This heel member holds the boot by its heel. In the case of a fall with twisting of the leg, the heel member 14 disconnects and releases the boot.

Figure 3:
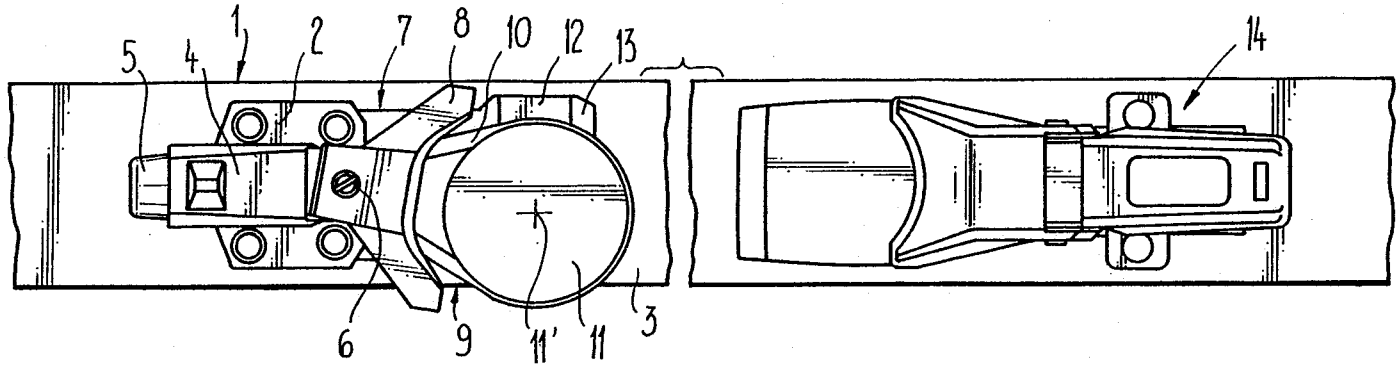
FIGS. 3 and 4 are plan views of the binding according to FIGS. 1 and 2 placed in pivoted position, without exceeding the limit of elasticity (FIG. 3) or after release of the boot (FIG. 4).
Figure 4:
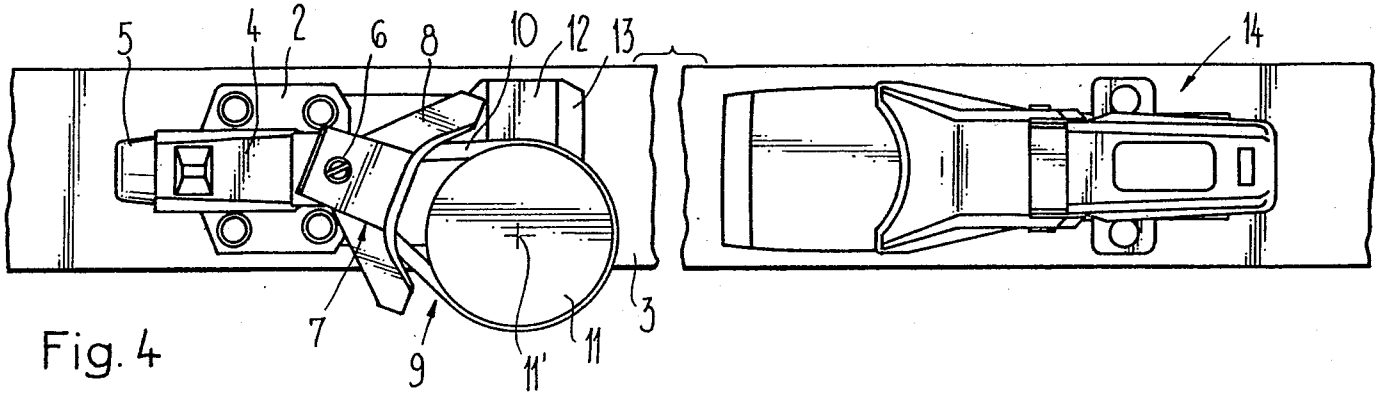

The operation of the front safety stop is as follows:

When a transverse force component exceeding a certain value is exerted, the jaw 7 illustrated in FIGS. 1 and 2 may pivot by rotating about one or the other of the two stops secured to the ski. When this lateral pivoting does not exceed an angle included within the limit of elasticity—position illustrated in FIGS. 3 - the jaw 7 may return to its normal position, returned by the release spring, without releasing the ski. On the other hand, when the limit of elasticity has been exceeded, for example in the course of a fall with twisting of the leg, jaw 7 pivots to the release position shown in FIG. 4 and the holding member 8 detaches sufficiently from the sole of the boot for the latter to be able to leave the ski freely. The jaw 7 may be returned manually to its normal position, without difficulty.

During this lateral pivoting of the jaw 7, stirrup 10 accompanies the rotation, of the jaw taking with it the support member 11. The latter, on which the weight of the boot rests, turns inside stirrup 10. There is therefore no relative displacement between the sole of the boot and the support member 11. Thus, the coefficient of friction, always variable according to the circumstances, between the sole of the boot and its support, exerts no influence on the releasing function of the front stop 1. As to the relative movement between member 8 holding the sole and the front end thereof, it may be taken into account by adjustment of the binding since the coefficient of friction between the holding member 8 and the front end of the sole does not vary to a substantial degree.

In certain cases, it may be useful to dispose the support member 11 in the pedal 9 so that it may slide over a certian length in the longitudinal direction of the ski. On the other hand, it is understandable that this pedal may take forms other than those shown in the drawings, the support member 11 also being able to be shaped differently.

It is obvious that other mechanisms for releasing the jaw 7 are possible. In particular, this mechanism may be designed according to the principle shown in U.S. Pat. No. 4,219,217.

FIGS. 5 to 12 illustrate, in views similar to those of FIGS. 1 and 2, other embodiments of the front stop according to the invention, which differ from that of FIGS. 1 to 4 only by the change in configuration of the pedal 9 or the support member 11. In FIGS. 5 to 12, like reference numerals are used as in FIGS. 1 to 4 to designate like members.

Figure 5:
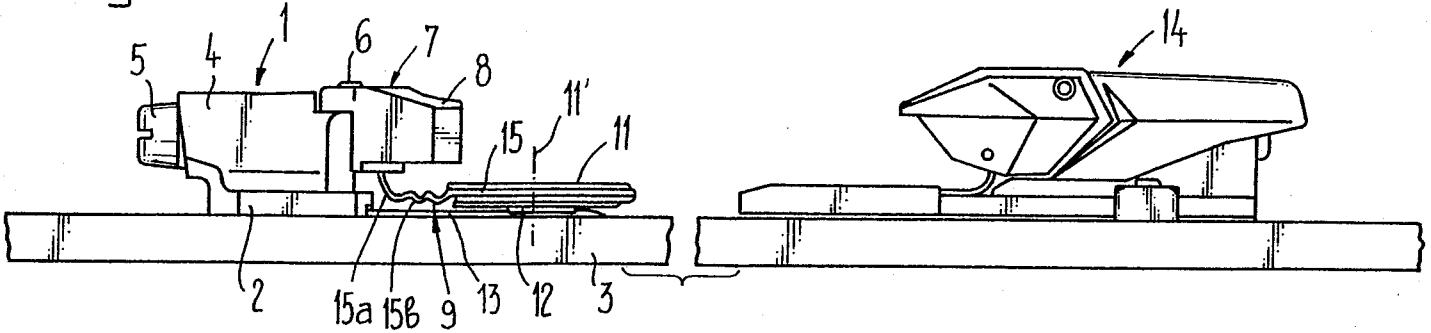
FIGS. 5 and 6, 7 and 8, 9 and 10, 11 and 12 illustrate, by corresponding views in elevation and planar views, alternative embodiments of the saftey stop according to the invention.
Figure 6:
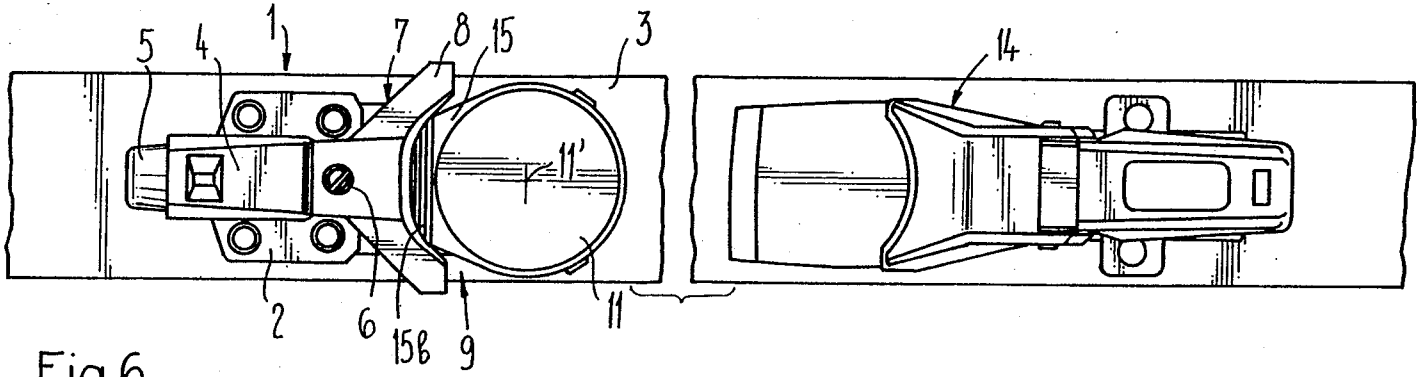

In the embodiment illustrated in FIGS. 5 and 6, the pedal comprises a support disc 11 which rotates with a retaining member 15. Retaining member 15 and support disc 11 may, however, be formed of one single integral piece. The member 15 is connected to member 8 for holding the sole by its front end 15*a*. The member 15 itself, or at least its median part 15*b*, is made of an elastically deformable material, for example rubber or flexible plastic material. The median part 15*b* may also be shaped so as to be deformable further to its particular shape. For example it may have corrugations of transverse axis as shown in FIGS. 5 qnd 6. In this way, when the jaw 7 pivots laterally, the support disc 11 may move with respect to the sole holding member 8 further to the deformation of the retaining member 15 or at least, of its median part 15*b*.

Due to the deformability of retaining member 15 or at least of its median part 15*b*, support disc 11, loaded by the weight of the boot which rests thereon, may, in the case of lateral pivoting of the jaw 7, accompany the movement of lateral pivoting of said boot, by rotating about its axis 11', no relative displacement being produced between the latter and disc 11. During this pivoting movement, retaining member 15 is deformed elastically, possibly by its median part 15*b*, since support disc 11 and sole holding member 8 follow different paths.

Figure 13:
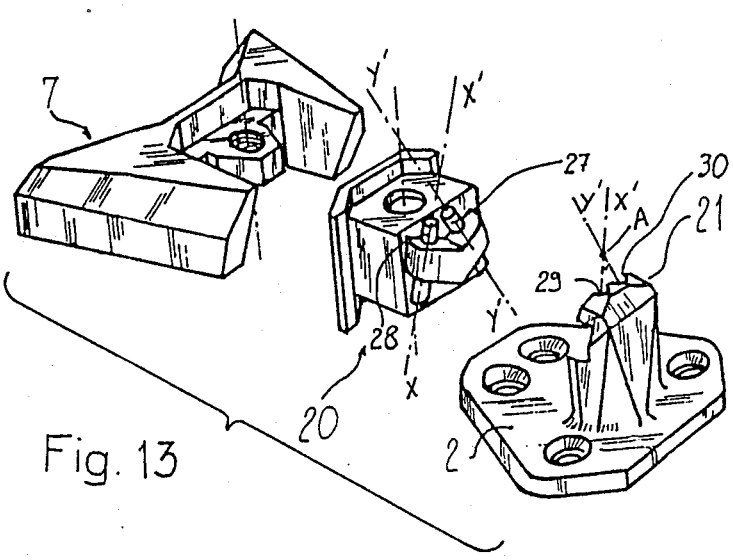
FIGS. 13 and 14 illustrate configurations of the binding assembly by which the assembly can pivot about either one of two convergent lines of support and two parallel lines of support, respectively.

Furthermore, support disc 11 may slide over a certain distance longitudinally with respect to the ski. In addition, pedal 9 may be detached and raised, this facilitating cleaning of the device. This arrangement has a particular advantage when the front stop is of the type in which jaw 7 may pivot laterally about two lines of support converging above the ski. These bindings form the subject matter of U.S. Pat. Nos. 4,178,014; 4,260,175; and 4,457,533. As shown in FIG. 13, the jaw 7, an intermediate member 20 and an energization member form a one-piece assembly, elastically mobile with respect to a support element 21, integral with base plate 2. The assembly is applied against the support element 21 under the action of the elastic system, along two lateral lines of support XX' and YY', disposed respectively on either side of the plane of symmetry of the ski, so that the assembly sometimes pivots on one of the lines of support, and sometimes on the other. These lines of support are materialized by projecting parts 27 and 28 on the intermediate member 20 cooperating with recessed parts 29 and 30, made in the rear face of support element 21. It is to be noted that one would not depart from the scope of the invention if the recessed parts were disposed on the intermediate member 20 and the projecting parts on the support element 21.

Figure 14:
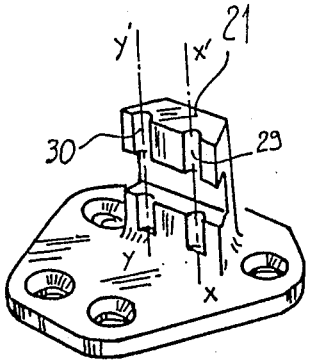

FIG. 14 shows a v ariant of the support element 21 in which the recessed profiles 29 and 30 are disposed parallel to define two lines of support XX' and YY' which are parallel and perpendicular to the plane of the ski. In fact, in this case, the jaw lifts slightly, during the lateral pivoting, and if the pedal 9 were rigid, it would lift with the jaw 7 and come under the sole, the friction then no longer being ensured under good conditions. On the contrary, if the pedal 9 is elastic, it remains in contact with the ski, in the course of release, due to its elastic deformation, and the boot rubs correctly on the pedal.

Figure 7:
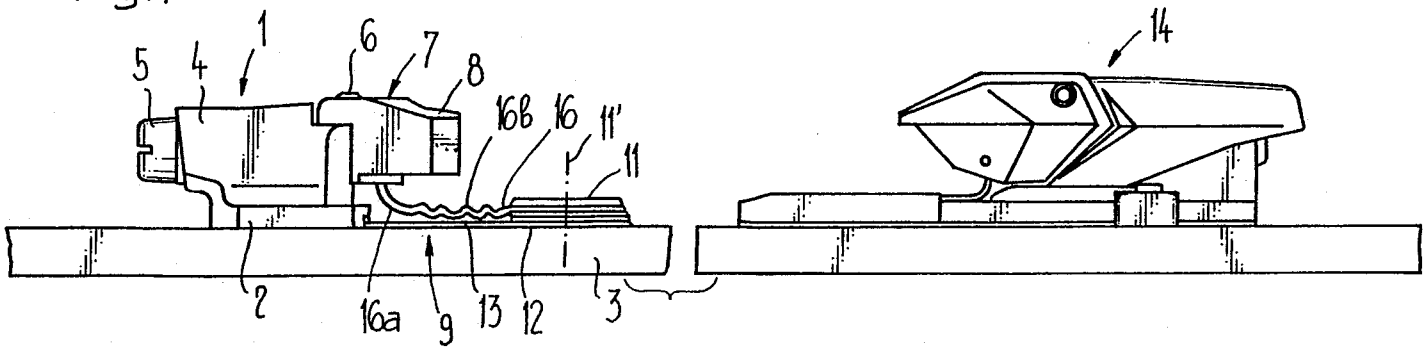
Figure 8:
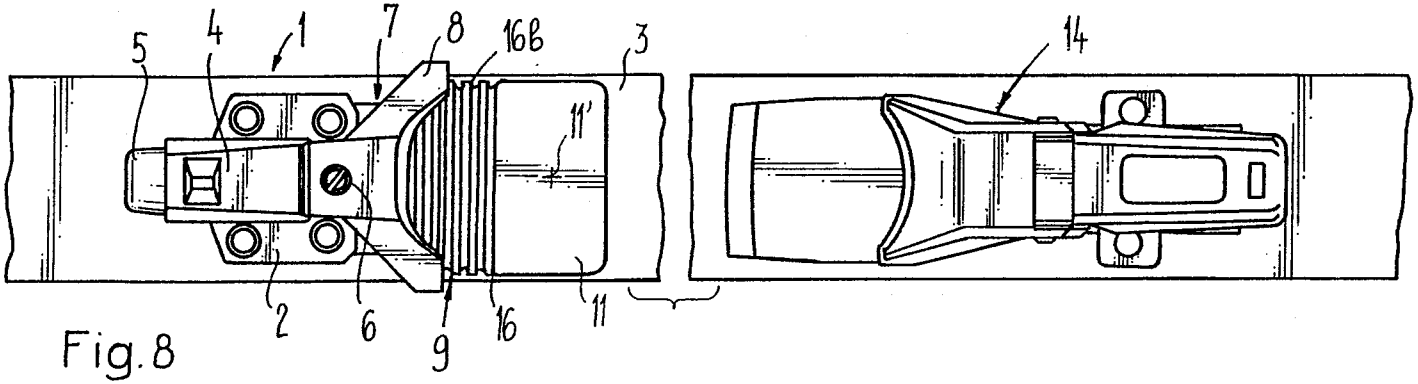

The alternative embodiment illustrated in FIGS. 7 and 8 is, to a large extent, similar to that of FIGS. 5 and 6. The support member 11, whose shape is different from that of disc 11 of FIGS. 5 and 6 (for example a rectangular plate), forms an integral part of the retaining member 16. The latter is connected by its front end 16*a* with holding member 8. The median part 16*b* of member 16 is elastically deformable to allow, as indicated in FIGS. 5 and 6, the support member 11 to accompany, in the case of lateral pivoting of the jaw 7, the movement of the boot due to a deformation, the member 11 rotating about its axis 11' perpendicular to the plane of the ski.

In this embodiment, support member 11 may also slide over a certain distance in the longitudinal direction of the ski 3 and may be slightly separated therefrom by lifting.

Figure 9:
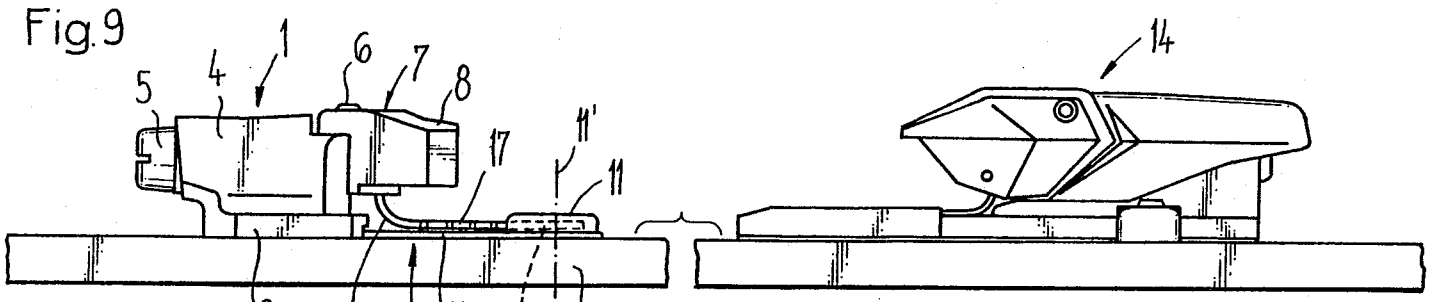
Figure 10:
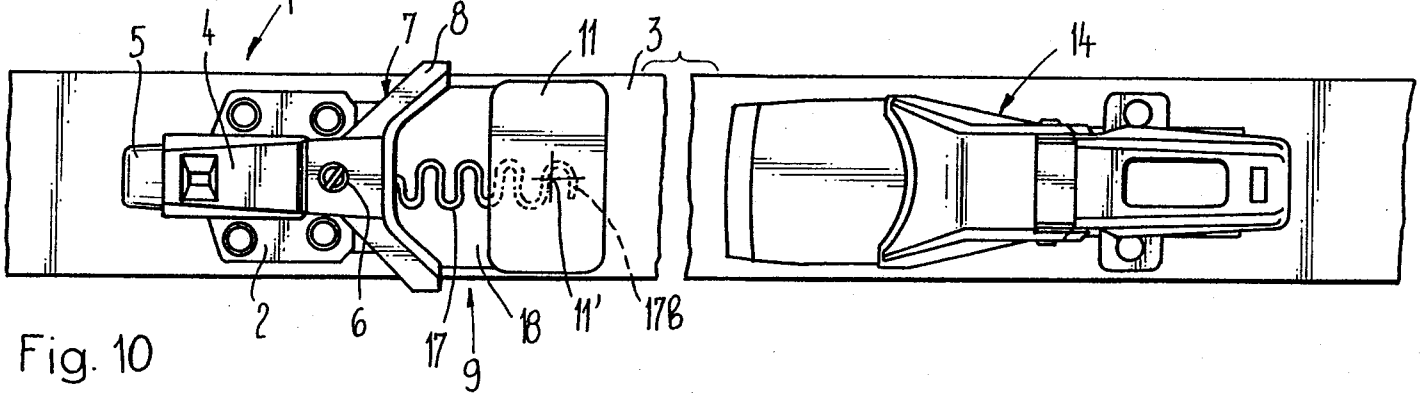

In the embodiment according to FIGS. 9 and 10, support member 11 which is preferably made of plastic material and which is for example rectangular in form, is fixed to the free end 17b of an elastic member 17 made of steel whose front end 17a is integral with sole holding member 8. This elastic member 17 may be constituted for example by a wire presenting undulations extending transversely in a plane parallel to the ski. The support member 11 rests on a steel plate 18 fast with the ski 3.

The elastic member 17 enables support member 11 to accompany the movement of the boot similarly to the above-described embodiments, by rotating about its axis 11' perpendicular to the ski, no reciprocal displacement consequently being produced between the sole of the boot and support member 11 in the case of lateral release.

There again, support member 11 may be detached from ski 3 by being raised; it may also slide over a certain distance along the length of the ski.

Figure 11:
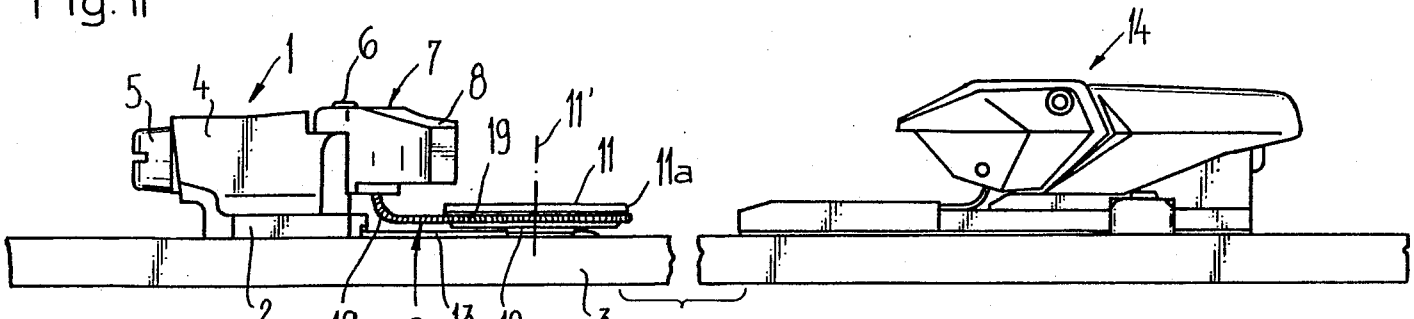
Figure 12:
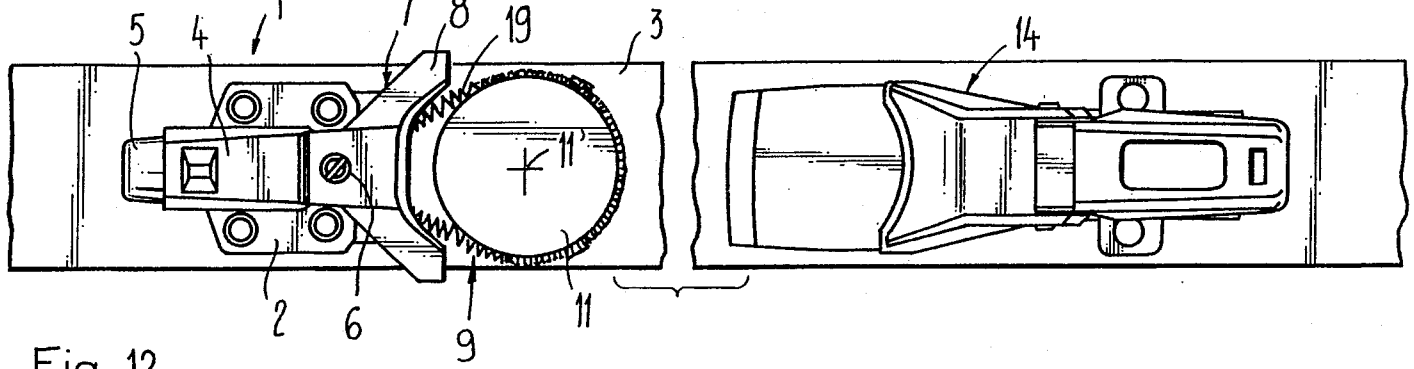

The embodiment according to FIGS. 11 and 12 differ from the solution illustrated in FIGS. 1 to 4, instead of allowing a rotation of the support disc 11 in a stirrup 10, disc 11 is integral with and rotates with an annular retaining member 19 constituted by a helical spring. The front 19*a* of retaining member 19 is connected to the sole holding member 8, the rest of member 19 being housed in a groove 11a which surrounds disc 11.

Since, contrary to what occurs in the variant according to FIGS. 1 to 4, the support disc is rigidly fast and rotates with the retaining member 19, this latter is stretched in one of its arms and compressed in the other by support disc 11 which rotates about its axis 11′ when jaw 7 and its holding member 8 pivot laterally. There is, therefore, no reciprocal displacement between the sole of the boot and its support disc 11.

Due to the arrangement, described hereinabove, of retaining ring 19, support disc 11 may also be detached from the ski. Similarly, a certain movement of disc 11 is possible in the longitudinal direction of the ski.

It is obvious that a binding system which allows a relative displacement between the member 8 for holding the sole and the support member 11 on which it rests, as appears in members 15, 16, 17 or 19, may take a form other than that indicated in FIGS. 5 to 12, whilst preventing any reciprocal displacement between the sole of the boot and the support member in the course of a lateral release.

In all examples cited, the retaining member 10, 15, 16, 17, 19 which holds support member 11, is attached to the jaw 7 or to its holding member 8, the end 10a, 15a, 16a, 17a, 19a of said retaining members ensuring the connection and consequently accompanying the pivoting movement of the jaw 7.

However, it would be possible to render the retaining members 10, 15, 16, 17 or 19 integral with the ski, i.e. to connect them, by their ends 10a, 15a, 16a, 17a or 19a, to a fixed element of the front stop 1, for example to the base plate 2, or directly to the ski 3. In such a case, the ends of retaining members will of the course be shaped differently from what is shown in the drawings. Similarly, the retaining members themselves must be arranged so that, in the case of lateral release of the front stop 1, support member 11 accompanies the movement of the boot without a relative displacement being made between the sole of the boot and support member 11.

This latter solution has the advantage of rendering jaw 7 independent of pedal 9, therefore of retaining members 10, 15, 16, 17, 19 and of the support member 11, from the point of view of construction.

The safety binding described is of the front stop type, but it may also be of the heel type to hold the heel of the boot.

In the embodiments described, the pedal is connected to the jaw but it may also be connected to a piece fast with the jaw without departing from the scope of the invention.

A retaining member may also be designed, identical to that of FIGS. 5 to 8, without undulations but sufficiently thin for it to be elastic.

What I claim is:

1. A safety binding for a ski comprising a jaw for holding a sole of a ski boot, said jaw being movable at least transversely with respect to the longitudinal axis of the ski and being resiliently held in its normal position, and a pedal secured to said jaw only by attachment means, and whereby said pedal comprises a support member adapted to pivot together with said boot relative to said jaw upon pivoting of said jaw.

2. The safety binding as defined by claim 1 wherein said support member is held in position by said attachment means only.

3. The safety binding as defined by claim 1 wherein said pedal further comprises a stirrup adapted to hold said support member while permitting said support member to pivot relative to said jaw.

4. The safety binding as defined by claim 3 wherein said stirrup is made of metal.

5. The safety binding as defined by claim 4 wherein said stirrup surrounds said support member, said support member being pivotable in said stirrup.

6. The safety binding as defined by claim 3 wherein said stirrup is configured as a spring, and wherein said pedal is adapted to pivot relative to said jaw, and be returned to its rest position by said spring stirrup upon release of said boot.

7. The safety binding as defined by claim 3 wherein said attachment means comprises a flexible skirt adapted to permit said pedal to pivot relative to said jaw.

8. The safety binding as defined by claim 3 wherein said attachment means comprises a spring extending from said jaw with said pedal being mounted on the end of said spring spaced from said jaw.

9. The safety binding as defined by claim 1 wherein said support member is movable in a plane substantially parallel to the ski.

10. The safety binding as defined by claim 1 wherein said support member is mounted to rotate within the remainder of said pedal.

11. The safety binding as defined by claim 1 wherein said support member rests on a smooth slide strip.

12. The safety binding as defined by claim 11 wherein said slide strip is made of plastic.

13. The safety binding as defined by claim 1 wherein said support member is in the form of a disc.

14. The safety binding as defined by claim 1 wherein said pedal further comprises a stirrup and wherein said support member comprises a groove around its periphery adapted to receive said stirrup therein.

15. The safety binding as defined by claim 11 wherein said stirrup surrounds said support member and ends in upwardly bent arms held by said jaw.

16. The safety binding as defined by claim 1 wherein said support member is further adapted to slide longitudinally along the axis of said ski relative to said jaw.

17. The safety binding as defined by claim 16 wherein said support member is further adapted to pivot about an axis substantially perpendicular to the surface of said ski.

18. The safety binding as defined by claim 1 wherein said support member is further adapted to slide perpendicular to the longitudinal axis of said ski.

19. The safety binding as defined by claim 1 wherein said attachment means is at least partially elastically deformable.

20. The safety binding as defined by claim 1 wherein said attachment means comprises at least one undulation along an axis transverse to the longitudinal axis of said ski.

21. The safety binding as defined by claim 20 wherein said support member is formed of an anti-friction material.

22. The safety binding as defined by claim 1 wherein said jaw is pivotable along either of two lines of support positioned symmetrically on opposite sides of the longitudinal plane of symmetry of said ski.

23. The safety binding as defined by claim 22 wherein said lines of support are parallel to one another and extend substantially perpendicular to the plane of said ski.

24. The safety binding as defined by claim 22 wherein said lines of support are convergent at a point located above the ski and extend substantially perpendicular to the plane of said ski.

25. A safety binding for a ski comprising a jaw for holding the sole of a ski boot, said jaw being movable at least transversely with respect to the longitudinal axis of the ski and being resiliently held in its normal position with a pedal secured to said jaw and passing under the end of the sole of the ski boot, said binding further comprising an elastically deformable element connecting said pedal to said jaw, wherein said elastically deformable element comprises at least one undulation along a direction transverse to the axis of the ski.

26. A safety binding according to claim 25 wherein said elastically deformable element is formed of steel wire having undulations.

27. The safety binding according to claim 25 wherein said pedal comprises a support member fixed with respect to the remainder of said pedal.

28. The safety binding according to claim 25 wherein said pedal comprises a support member movable with respect to the remainder of said pedal.

29. The safety binding according to claim 28 wherein said support member is mounted to rotate in the remainder of said pedal.

* * * * *